US008534708B2

(12) United States Patent
Heim et al.

(10) Patent No.: US 8,534,708 B2
(45) Date of Patent: Sep. 17, 2013

(54) SEE-THROUGH SECURITY ELEMENT WITH MICROSTRUCTURES

(75) Inventors: Manfred Heim, Munich (DE); Marius Dichtl, Munich (DE); Michael Rahm, Hemau (DE)

(73) Assignee: Giesecke & Devrient GmbH, Munich (DE)

( * ) Notice: Subject to any disclaimer, the term of this patent is extended or adjusted under 35 U.S.C. 154(b) by 307 days.

(21) Appl. No.: 12/446,494

(22) PCT Filed: Oct. 16, 2007

(86) PCT No.: PCT/EP2007/008953
§ 371 (c)(1),
(2), (4) Date: Apr. 21, 2009

(87) PCT Pub. No.: WO2008/049533
PCT Pub. Date: May 2, 2008

(65) Prior Publication Data

US 2010/0194091 A1 Aug. 5, 2010

(30) Foreign Application Priority Data

Oct. 24, 2006 (DE) ..... 10 2006 050 047

(51) Int. Cl.
*B42D 15/00* (2006.01)

(52) U.S. Cl.
USPC ..... 283/72; 235/488; 283/103; 283/113; 283/89; 283/91

(58) Field of Classification Search
USPC ..... 283/72, 89, 91, 94; 349/187; 428/29, 428/120
See application file for complete search history.

(56) References Cited

U.S. PATENT DOCUMENTS

| | | | | |
|---|---|---|---|---|
| 2,053,173 | A | 9/1936 | Astima | |
| 3,031,351 | A | 4/1962 | McIlvaine | |
| 3,542,789 | A | 11/1970 | Satzinger | |
| 3,887,742 | A | 6/1975 | Reinnagel | |
| 4,168,986 | A * | 9/1979 | Venis, Jr. | 106/417 |
| 4,764,410 | A | 8/1988 | Grzywinski | |
| 4,766,023 | A | 8/1988 | Lu | |

(Continued)

FOREIGN PATENT DOCUMENTS

| | | |
|---|---|---|
| CA | 2309960 A1 | 5/1999 |
| DE | 4226906 A1 | 2/1994 |

(Continued)

OTHER PUBLICATIONS

International Search Report, International Application No. PCT/EP2007/008953, 6 pages, Oct. 20, 2008.

(Continued)

*Primary Examiner* — Joanne Silbermann
*Assistant Examiner* — Shin Kim
(74) *Attorney, Agent, or Firm* — Lathrop & Gage LLP

(57) ABSTRACT

The present invention relates to a see-through security element (12), for security papers, value documents and the like, having at least one micropattern having a visual appearance that is viewing-angle dependent when looked through (26, 28). According to the present invention, the at least one micropattern is formed from an arrangement of a plurality of pattern elements (24) having a characteristic pattern spacing of 1 μm or more, and the see-through security element (12) exhibits a total thickness of 50 μm or less.

32 Claims, 7 Drawing Sheets

(56) References Cited

U.S. PATENT DOCUMENTS

Figure 1:
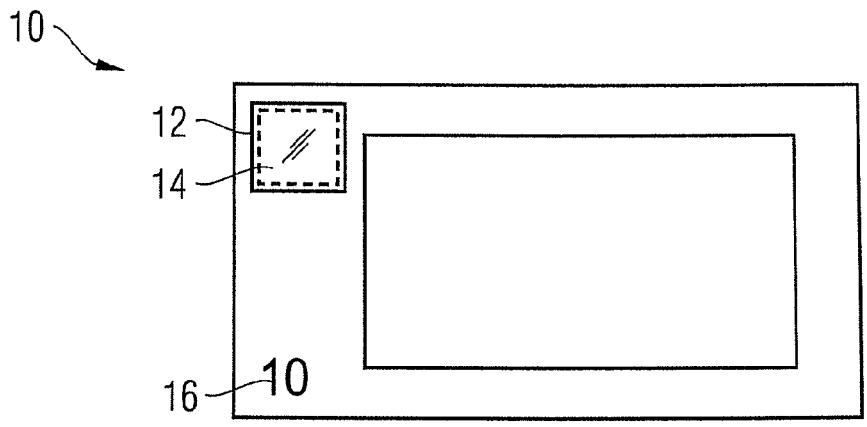

| | | | | |
|---|---|---|---|---|
| 5,204,160 | A * | 4/1993 | Rouser | 428/167 |
| 5,642,226 | A | 6/1997 | Rosenthal | |
| 5,714,213 | A * | 2/1998 | Antes et al. | 428/30 |
| 5,928,788 | A * | 7/1999 | Riedl | 428/411.1 |
| 5,972,546 | A * | 10/1999 | Bjelkhagen | 430/10 |
| 6,089,614 | A * | 7/2000 | Howland et al. | 283/91 |
| 6,505,779 | B1 * | 1/2003 | Power et al. | 235/488 |
| 6,870,681 | B1 | 3/2005 | Magee | |
| 6,987,590 | B2 * | 1/2006 | Phillips et al. | 359/2 |
| 7,667,894 | B2 | 2/2010 | Hoffmuller | |
| 7,728,931 | B2 | 6/2010 | Hoffmuller | |
| 7,808,605 | B2 | 10/2010 | Hoffmuller | |
| 2003/0230816 | A1 | 12/2003 | Kappe et al. | |
| 2004/0084893 | A1 * | 5/2004 | Fan et al. | 283/72 |
| 2005/0224203 | A1 | 10/2005 | Boehm et al. | |
| 2006/0196948 | A1 * | 9/2006 | Weber et al. | 235/487 |
| 2007/0165182 | A1 | 7/2007 | Hoffmuller et al. | |
| 2007/0211238 | A1 | 9/2007 | Hoffmuller et al. | |
| 2007/0216518 | A1 | 9/2007 | Hoffmuller et al. | |
| 2007/0229928 | A1 | 10/2007 | Hoffmuller et al. | |
| 2007/0241553 | A1 | 10/2007 | Heim et al. | |
| 2007/0246933 | A1 | 10/2007 | Heim et al. | |
| 2007/0274559 | A1 | 11/2007 | Depta et al. | |
| 2008/0014378 | A1 | 1/2008 | Hoffmuller et al. | |
| 2008/0054621 | A1 | 3/2008 | Burchard et al. | |
| 2008/0079257 | A1 | 4/2008 | Fessl | |
| 2008/0088859 | A1 | 4/2008 | Depta et al. | |
| 2008/0094713 | A1 | 4/2008 | Schilling et al. | |
| 2008/0095986 | A1 | 4/2008 | Schilling et al. | |
| 2008/0160226 | A1 | 7/2008 | Kaule et al. | |
| 2008/0163994 | A1 | 7/2008 | Hoppe et al. | |
| 2008/0198468 | A1 | 8/2008 | Kaule et al. | |
| 2008/0216976 | A1 | 9/2008 | Ruck et al. | |
| 2008/0250954 | A1 | 10/2008 | Depta et al. | |
| 2008/0258456 | A1 | 10/2008 | Rahm et al. | |
| 2009/0001709 | A1 | 1/2009 | Kretschmar et al. | |
| 2009/0008923 | A1 | 1/2009 | Kaule et al. | |
| 2009/0008926 | A1 | 1/2009 | Depta et al. | |
| 2009/0102605 | A1 | 4/2009 | Kaule | |
| 2009/0115185 | A1 | 5/2009 | Hoffmuller et al. | |
| 2009/0127844 | A1 | 5/2009 | Dorfler et al. | |
| 2009/0236061 | A1 | 9/2009 | Gruszczynski et al. | |
| 2009/0297805 | A1 | 12/2009 | Dichtl | |
| 2009/0322071 | A1 | 12/2009 | Dichtl | |
| 2010/0151207 | A1 | 6/2010 | Hansen et al. | |

FOREIGN PATENT DOCUMENTS

| | | | |
|---|---|---|---|
| DE | 4421407 | C1 | 6/1995 |
| DE | 102004042111 | A1 | 3/2006 |
| DE | 102004042136 | A1 | 3/2006 |
| DE | 102006029852 | A1 | 1/2008 |
| JP | 2004209940 | A | 7/2004 |
| JP | 2004262144 | A | 9/2004 |
| JP | 2005035115 | A | 2/2005 |
| WO | WO 97/18092 | A1 | 5/1997 |
| WO | WO 97/47478 | A1 | 12/1997 |
| WO | WO 99/24265 | A1 | 5/1999 |
| WO | WO 02/11063 | A2 | 2/2002 |
| WO | WO 03/054297 | A2 | 7/2003 |
| WO | WO 2005/110772 | A1 | 11/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018172 | | 2/2006 |
| WO | WO 2006040069 | | 4/2006 |
| WO | WO 2006056342 | | 6/2006 |
| WO | WO 2006072380 | | 7/2006 |
| WO | WO 2006/087138 | A1 | 8/2006 |
| WO | WO 2006087138 | | 8/2006 |
| WO | WO 2006/095161 | A2 | 9/2006 |
| WO | WO 2006099971 | | 9/2006 |
| WO | WO 2006/108611 | A2 | 10/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007076952 | | 7/2007 |
| WO | WO 2007079851 | | 7/2007 |
| WO | WO 2007115648 | | 10/2007 |
| WO | WO 2007/128426 | A2 | 11/2007 |
| WO | WO 2008/000350 | | 1/2008 |
| WO | WO 2008/000351 | | 1/2008 |

OTHER PUBLICATIONS

International Preliminary Report on Patentability, International Application No. PCT/ EP2007/008953, 7 pages, Jul. 2, 2009, English Translation.

* cited by examiner

SEE-THROUGH SECURITY ELEMENT WITH MICROSTRUCTURES

CROSS-REFERENCE TO RELATED APPLICATIONS

This application is the U.S. National Stage of International Application No. PCT/EP2007/008953, filed Oct. 16, 2007, which claims the benefit of German Patent Application DE 10 2006 050 047.4, filed Oct. 24, 2006; both of which are hereby incorporated by reference to the extent not inconsistent with the disclosure herewith.

The present invention relates to a see-through security element, for security papers, value documents and the like, having at least one micropattern having a visual appearance that is viewing-angle dependent when looked through.

For protection, data carriers, such as value or identification documents, or other valuable articles, such as branded articles, are often provided with security elements that permit the authenticity of the data carriers to be verified, and that simultaneously serve as protection against unauthorized reproduction. The security elements can be developed, for example, in the form of a security thread embedded in a banknote, a tear strip for product packaging, an applied security strip, a cover foil for a banknote having a through opening, or a self-supporting transfer element, such as a patch or a label that, after its manufacture, is applied to a value document.

Security elements having viewing-angle-dependent effects play a special role in safeguarding authenticity, as these cannot be reproduced even with the most modern copiers. Here, the security elements are furnished with optically variable elements that, from different viewing angles, convey to the viewer a different image impression and, depending on the viewing angle, display for example another color or brightness impression and/or another graphic motif.

Based on that, the object of the present invention is to specify a see-through security element of the kind cited above that avoids the disadvantages of the background art. In particular, as a security feature, the see-through security element is intended to exhibit an easily perceptible piece of optical information that offers high counterfeit protection and that requires no special illumination conditions for the authenticity check.

This object is solved by the see-through security feature having the features of the main claim. A security paper, a data carrier and a corresponding manufacturing method are specified in the coordinated claims. Developments of the present invention are the subject of the dependent claims.

According to the present invention, in a generic see-through security element, the at least one micropattern is formed from an arrangement of a plurality of pattern elements having a characteristic pattern spacing of 1 μm or more. Furthermore, according to the present invention, the see-through security element exhibits a total thickness of 50 μm or less.

The inventive arrangement of a plurality of pattern elements can be a regular or irregular arrangement, or an arrangement that is regular in some regions. The present invention thus encompasses any arrangement of a plurality of pattern elements that exhibits a pattern spacing of 1 μm or more.

The see-through security element preferably exhibits a transparent or translucent substrate and, applied on the substrate, a marking layer that includes the at least one micropattern.

In principle, any transparent or translucent substrate can be used for the see-through security element. Here, the transmittance must be at least so large that the viewing-angle-dependent appearance can be perceived by the viewer in transmitted light. The use of an additional illumination means to improve the perceptibility of the appearance by the viewer is conceivable, even if, according to the present invention, the thickness of the material is chosen such that the optically variable appearance of the see-through security element is possible also without auxiliary means.

Accordingly, paper, especially cotton vellum paper, is, in principle, conceivable as a substrate. Of course also paper that includes a portion x of polymer material in the range from $0<x<100$ wt. % can be used.

However, it is particularly preferred when the substrate is a plastic, especially a plastic foil, e.g. a foil composed of polyethylene (PE), polyethylene terephthalate (PET), polybutylene terephthalate (PBT), polyethylene naphthalate (PEN), polypropylene (PP) or polyamide (PA). Further, the foil can be stretched monoaxially or biaxially. The stretching of the foil causes it to, among other things, gain polarizing properties that can be used as a further security feature. The auxiliary means required to take advantage of these properties, such as polarization filters, are known to the person of skill in the art.

It can also be expedient when the substrate is a multilayer laminate, especially a laminate of multiple different foils (composite laminate). Here, the foils of the laminate can be formed e.g. from the above-mentioned plastic materials. Such a laminate is distinguished by an extraordinarily high stability, which is of great advantage for the durability of the security element. These laminate materials can also be used with great advantage in certain climate regions of the earth.

All materials used as a substrate can exhibit additives that serve as authenticating features. Here, primarily luminescent substances that are preferably transparent in the visible wavelength range and, in the non-visible wavelength range, can be excited by a suitable auxiliary means, e.g. a UV- or IR-radiation-emitting radiation source, are to be considered in order to produce a luminescence that is visible or at least detectable. Of course also the marking layer, that is, e.g., the lacquers or inks used for the micropattern, can exhibit the above-mentioned additives.

In an advantageous variant of the present invention, the marking layer of the see-through security element constitutes a colored embossing lacquer layer whose regions that are left standing when embossing, i.e. non-embossed regions, form the pattern elements of the at least one micropattern.

In another, likewise advantageous variant of the present invention, the marking layer of the see-through security element is a transparent or translucent embossing lacquer layer that exhibits embossed depressions that are subsequently filled with colored material and that form the pattern elements of the at least one micropattern. The depressions can exhibit any form or contour shape. Hereinafter, also the term "trenches" is used for these depressions.

In a further, likewise advantageous variant of the present invention, the marking layer of the see-through security element is a printing layer having regions of high transmittance and having regions of low transmittance, the regions of low transmittance forming the pattern elements of the at least one micropattern.

According to yet a further advantageous variant of the present invention, the marking layer of the see-through security element is a micro intaglio layer having regions of high transmittance and having regions of low transmittance, the regions of low transmittance forming the pattern elements of the at least one micropattern. The properties of such micro intaglio layers and methods for their manufacture will be described in greater detail below.

The see-through security element preferably exhibits a total thickness of 20 μm or less, particularly preferably of 3 μm to 10 μm. The pattern elements of the micropattern expediently exhibit a characteristic pattern spacing of 5 μm or more. Further, according to an advantageous embodiment, it is provided that the pattern elements each exhibit a pattern size of 1 μm or more, preferably of 3 μm or more. For the profile of the pattern elements, height-to-width ratios from about 1:5 up to about 5:1 are considered advantageous, and from about 1:1 up to about 5:1 particularly advantageous.

According to a development of the present invention, at least one of, if applicable, multiple micropatterns is formed by a lamellar pattern composed of a plurality of substantially parallel lamellae. The visual appearance of the micropatterns then changes when the security element is rotated or tilted due to the changing viewing direction relative to the parallel lamellae.

Particularly preferably, in the security element, multiple micropatterns formed by lamellar patterns are provided that differ in one or more of the parameters lateral orientation, color, width, height, relief shape and spacing.

Here, the differing lamellar patterns can advantageously be arranged in the form of patterns, characters or a code that appear, change or disappear especially when the security element is rotated or tilted.

According to another development of the present invention, at least one of, if applicable, multiple micropatterns is formed by a plurality of depressions having an increased transmittance in a marking layer, such that the visual appearance of the micropattern changes when the security element is rotated or tilted due to the changing viewing direction relative to the depressions. Here, the plurality of depressions can advantageously be arranged in the form of patterns, characters or a code that appear, change or disappear especially when the security element is rotated or tilted.

According to a preferred embodiment of the present invention, the pattern elements are provided in sub-regions with an opaque, transparent, semitransparent, reflective or absorbing coating. Here, the coating can be developed to be monolayer or multilayer and particularly advantageously as a thin-film element having a color-shift effect, that is, to be optically variable. Coatings composed of so-called pearlescent pigments are prime examples of monolayer thin-film elements. Multilayer thin-film elements are generally developed as purely dielectric thin film structures or metallic/dielectric multi-ply structures. Presently, for the multilayer thin-film elements, three-layer interference layer structures (metallic/dielectric three-ply structure) are particularly preferred.

Furthermore, the pattern elements can be provided in sub-regions with a metallic coating, with a light-absorbing moth-eye pattern or also with a diffractive pattern that diffracts substantial portions of the incident light away from the viewer.

It is particularly preferred when the pattern elements exhibit an asymmetrically arranged coating, moth-eye pattern or diffractive pattern. In the case of a coating, the asymmetric arrangement on the pattern elements can be achieved, for example, through oblique vapor deposition.

In a further advantageous embodiment of the present invention, the see-through security element exhibits a transparent or translucent substrate having a first and an opposing second surface, a see-through mask being applied to the first surface as a micropattern. A congruent see-through mask is applied to the second surface with a predetermined lateral offset of 100 μm or less.

The see-through mask preferably includes a motif in the form of patterns, characters or a code that is visually perceptible when looked through only at a certain viewing angle.

Particularly advantageously, the see-through masks are each formed by an opaque layer having light-transmitting openings, the openings exhibiting a size of less than 200 μm, preferably a size of about 3 μm to about 100 μm, and forming a motif in the form of patterns, characters or a code. The offset of the see-through mask is coordinated with the size of the openings and the thickness of the substrate and is preferably significantly less than 100 μm, for example only about 20 μm or less, or even only about 10 μm or less.

The see-through security element according to the present invention can advantageously exhibit further security elements in order to further increase the counterfeit security. For example, the additional security element can be a transparent or semitransparent coating that is structured to be mono- or multilayer. Optically variable layers, especially interference layers, can advantageously be used for the additional coatings. The person of skill in the art is sufficiently familiar with purely dielectric thin film structures, metallic/dielectric multi-ply structures and the materials used in each case for the layers of these interference layer systems. Of course an additional security element can also be taken as part of the see-through security element according to the present invention, especially when, as in the case of the already mentioned thin-film elements having a color-shift effect, the further security element (interference layer structure) is arranged on or under the micropattern. In any case, through the synergistic coaction of the micropattern with the further security element, a significant increase in the counterfeit security and an enhancement of the optical appearance of the see-through security element according to the present invention results.

The additional coating can be superimposed on or laid under the micropattern of the see-through security element. A particularly impressive, additional optically variable effect can be obtained, for example, when the additional optically variable coating is arranged between the transparent or translucent substrate and the marking layer that includes the micropattern. The synergistic coaction of the optically variable micropattern and the additional optically variable coating significantly increases the counterfeit security of the see-through security element.

The additional coating can exhibit machine-readable properties at least in some regions. The additional coating also advantageously exhibits magnetic, electrically conductive or luminescent properties.

However, the additional security element can also advantageously be diffraction patterns, kinematic patterns or matte patterns. For example, as diffraction patterns, holograms can be used that are provided with a transparent or semitransparent metal layer or high-index dielectric coating. For these additional security elements, too, the counterfeit security is increased particularly in that the additional security element is either superimposed on or laid under the micropattern of the see-through security element, or is arranged practically without spatial distance next to the micropattern.

The additional security element can also be developed in the form of a liquid crystal layer, especially as a cholesteric or nematic liquid crystal layer, or in the form of a multilayer arrangement of cholesteric and/or nematic liquid crystals. It is also possible to develop the additional security element as a printing element. The printing element can advantageously include an ink that absorbs and/or emits in the infrared (IR) or ultraviolet wavelength range (fluorescence or phosphorescence), which facilitates machine detection. The printing element can also include optically variable or iridescent pigments.

Finally, also a non-diffractive or diffractive lens structure, for example a Fresnel lens arrangement, is combinable with the micropattern according to the present invention as an additional security element.

The present invention also comprises a method for manufacturing a see-through security element of the kind described, in which the see-through security element is provided with at least one micropattern having a visual appearance that is viewing-angle dependent when looked through, the at least one micropattern is formed from an arrangement of a plurality of pattern elements having a characteristic pattern spacing of 1 μm or more, and the see-through security element is produced having a total thickness of 50 μm or less.

The at least one micropattern is formed in the form of an arrangement of a plurality of pattern elements that is regular, irregular or regular in some regions.

In the method according to the present invention, to a transparent or translucent substrate is advantageously applied a marking layer in which the at least one micropattern is developed.

According to one method variant, as a marking layer, a colored embossing lacquer layer is applied, for example, imprinted, and the embossing lacquer layer is patterned, by means of embossing techniques, in such a way that the regions that are left standing when embossing, i.e. non-embossed regions, form the pattern elements of the at least one micropattern.

In another method variant, as a marking layer, a transparent or translucent embossing lacquer layer is applied, for example imprinted, and depressions are introduced into the embossing lacquer layer by means of embossing techniques. The depressions in the embossing lacquer layer are then filled with colored material, for example a printing ink, such that the filled depressions form the pattern elements of the at least one micropattern. The depressions can exhibit any shape and, in the following, are also referred to as "trenches".

In a further method variant, a printing layer having regions of high transmittance and having regions of low transmittance is applied as a marking layer, the regions of low transmittance forming the pattern elements of the at least one micropattern.

In principle, different methods are conceivable with which a see-through security element according to the present invention can be manufactured. Thus, the per se known methods will not be addressed in greater detail in the following.

However, the micro intaglio method is mentioned here as a particularly advantageous method variant in which the micropattern is applied to the substrate in that a) a die form is provided whose surface exhibits an arrangement of elevations and depressions in the form of the desired micropattern,
b) the depressions in the die form are filled with a curable colored or colorless lacquer,
c) the substrate is pretreated for a good anchoring of the colored or colorless lacquer,
d) the surface of the die form is brought into contact with the substrate,
e) the lacquer that is in contact with the substrate in the depressions in the die form is cured and, in the process, joined with the substrate, and
f) the surface of the die form is removed from the substrate again such that the cured lacquer that is joined with the substrate is pulled out of the depressions in the die form.

For further embodiments of this micro intaglio method and the associated advantages, reference is made to German patent application 10 2006 029 852.7, whose disclosure in this regard is incorporated in the present application.

For the micro intaglio method, it is particularly preferred when the depressions in the die form are filled in step b) with a radiation-curing lacquer and the lacquer is cured in step e) by impingement with radiation, especially with UV radiation. Furthermore, the lacquer can advantageously be precured in the depressions in the die form prior to the bringing-into-contact in step d).

The micropattern of the die form is advantageously formed by micropattern elements having a line width between about 1 μm and about 10 μm. It is also preferred when the micropattern of the die form is formed by micropattern elements having a pattern depth between about 1 μm and about 10 μm, preferably between about 1 μm and about 5 μm.

In an expedient variant of the method according to the present invention, the see-through security element is produced having a total thickness of 20 μm or less, preferably of 3 μm to 10 μm.

Further, at least one micropattern can be formed by a lamellar pattern composed of a plurality of substantially parallel lamellae.

Alternatively, however, it is also conceivable that at least one micropattern is formed in a marking layer by a plurality of depressions having an increased transmittance.

In a development of the described method, the pattern elements are provided in sub-regions with an opaque, transparent, semitransparent, reflective or absorbing coating, especially with a metallic coating, a moth-eye pattern or a diffractive pattern.

In another advantageous embodiment of the method according to the present invention, a transparent or translucent substrate having a first surface and an opposing second surface is provided, a see-through mask is applied to the first surface as a micropattern, and a congruent see-through mask is applied to the second surface with a predetermined lateral offset of 100 μm or less.

Here, in an advantageous method, the see-through masks are applied simultaneously to the opposing surfaces of the substrate. Alternatively, the see-through masks can also be applied to the opposing surfaces of the substrate in succession. The see-through masks are particularly preferably applied to the opposing sides of the substrate by means of the above-described micro intaglio technique.

The present invention also comprises a security paper for the manufacture of security or value documents, such as banknotes, checks, identification cards, certificates or the like, and a data carrier, especially a branded article, a value document or the like, the security paper and the data carrier being furnished with a security element of the kind described.

Through the described measures, it is ensured that the see-through security elements according to the present invention are thin enough to also be able to be used in the realm of value documents, and that, with the proposed methods, they can also be manufactured economically in the required high quantities. The pattern spacing of 1 μm or more, or the pattern size of 1 μm or more, ensures that the micropatterns appear largely achromatic, so without distracting color splitting. The optically variable effects can thus be perceived with no problem also in unfavorable illumination conditions.

With the see-through security element according to the present invention, advantageously, a number of so-called motion effects can be achieved that, on the one hand, further improve the counterfeit security, and on the other hand, are very visually appealing for the viewer. In that the see-through security element is broken down into a plurality of regions in which micropatterns having different viewing-angle-dependent tilt effects are arranged, motion effects can be achieved that are also referred to as flip, running or pump effects. With these effects, upon tilting the see-through security element, the viewer perceives an apparent movement of the observed pattern due to the optical impression that alternates in a defined manner.

Further exemplary embodiments and advantages of the present invention are described below with reference to the drawings. To improve clarity, a depiction to scale and proportion was dispensed with in the drawings.

Figure 2:
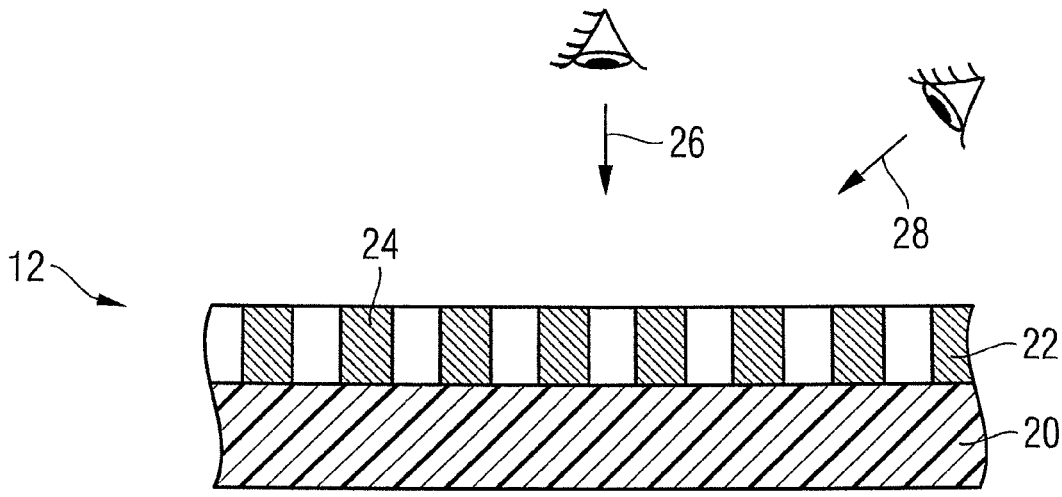
Figure 3:
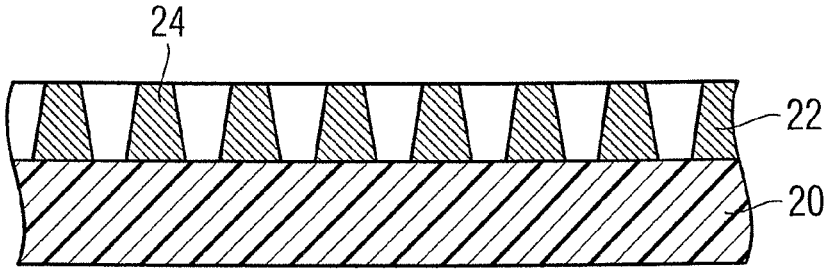
Figure 4A:
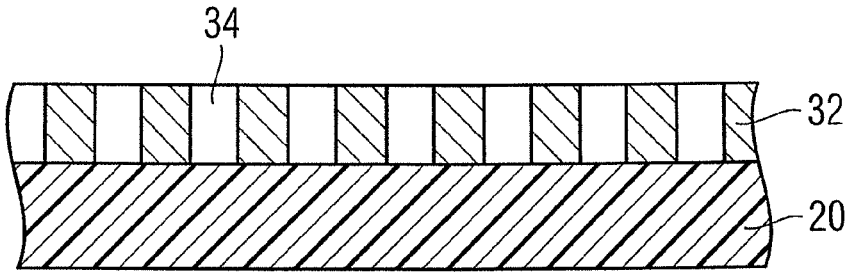
Figure 4B:
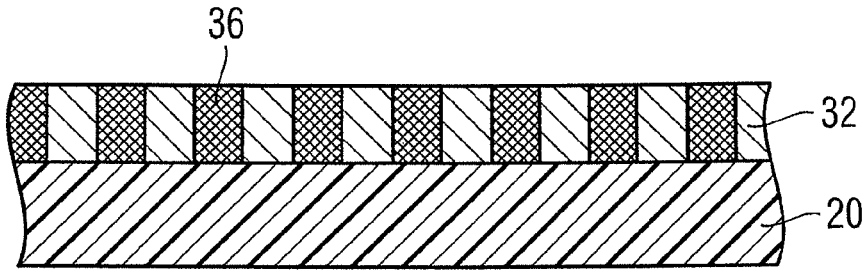
Figure 5:
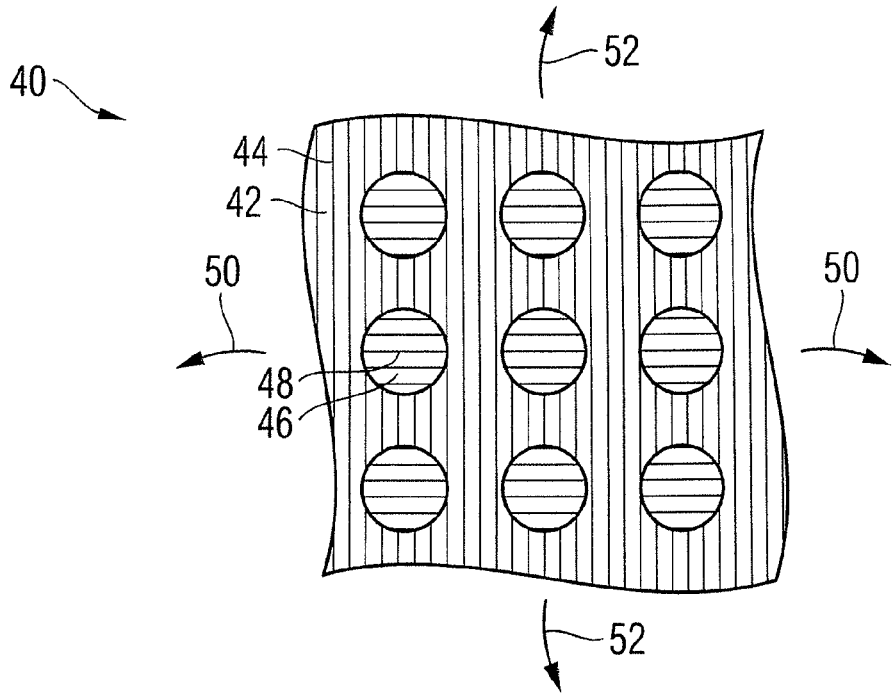
Figure 6:
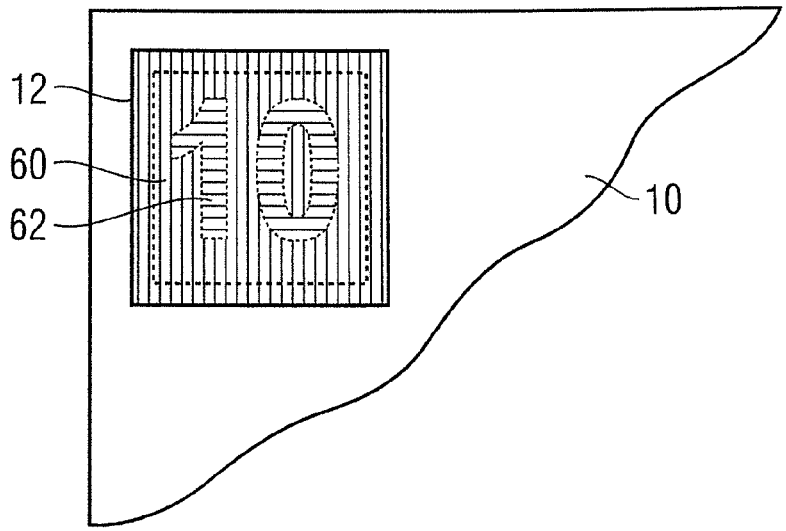
Figure 7:
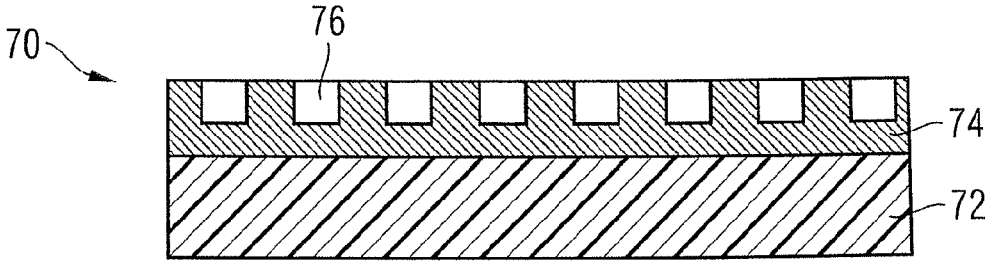
Figure 8A:
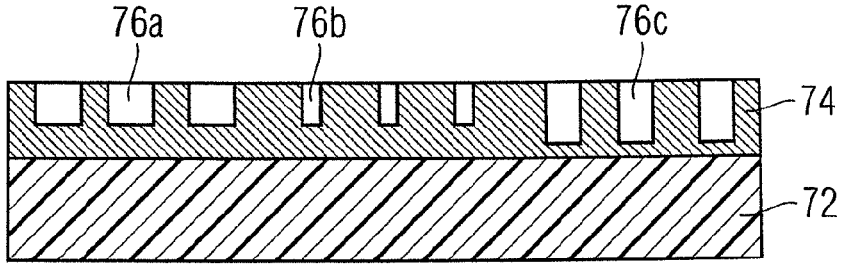
Figure 8B:
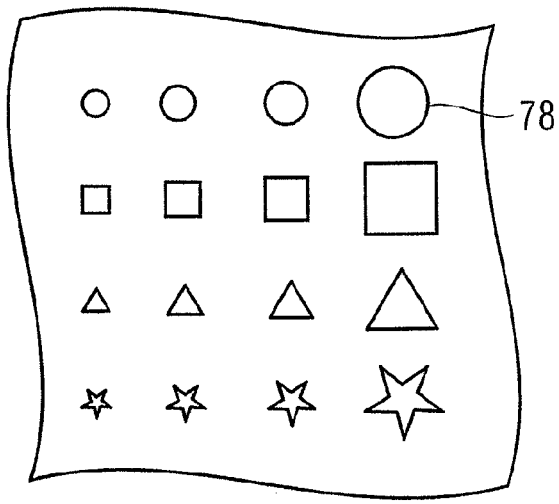
Figure 9:
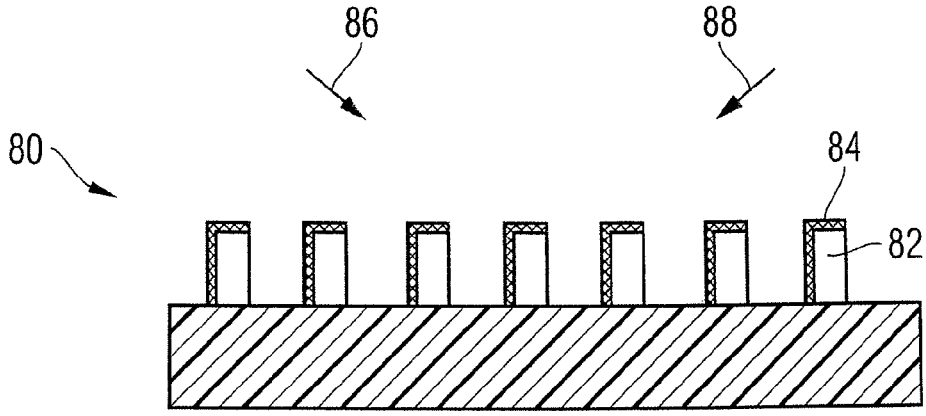
Figure 10:
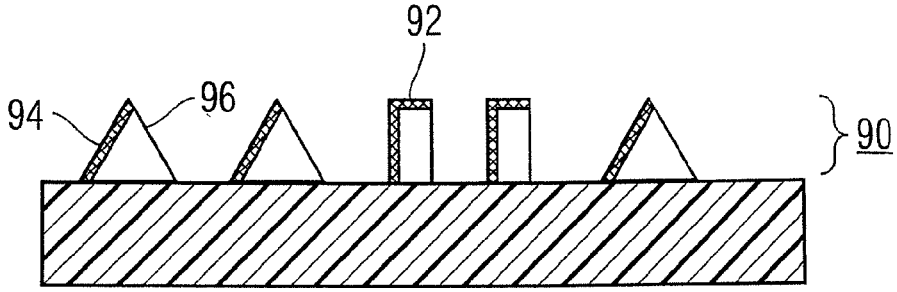
Figure 11:
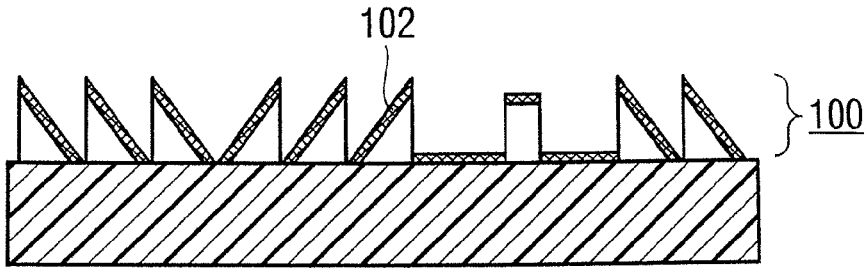
Figure 12:
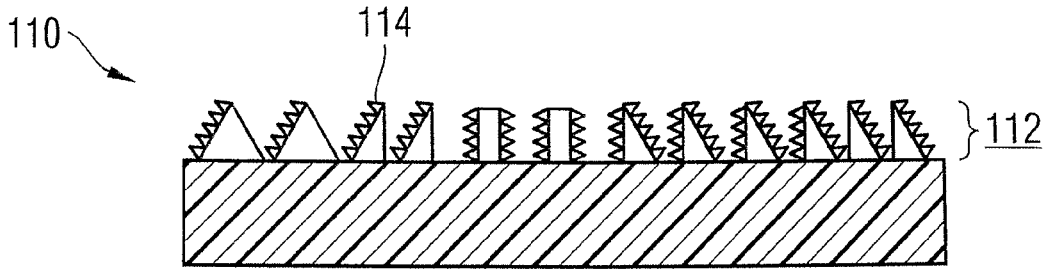
Figure 13A:
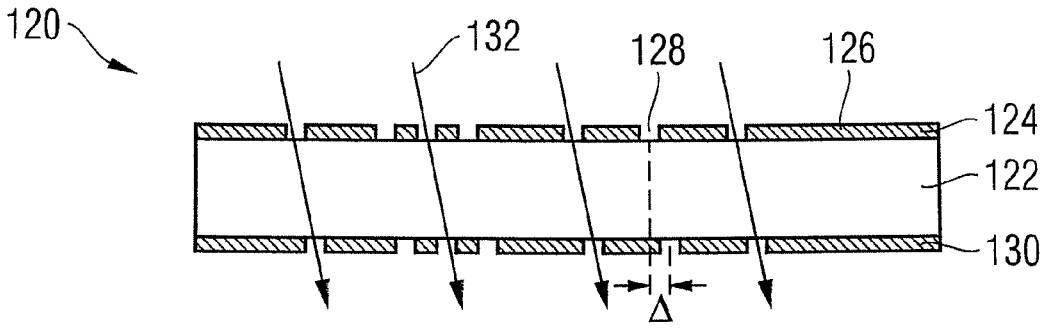
Figure 13B:
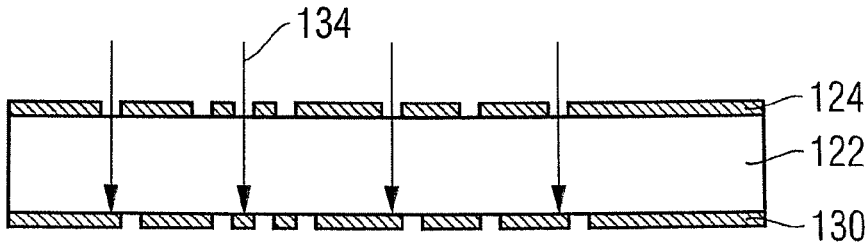
Figure 14:
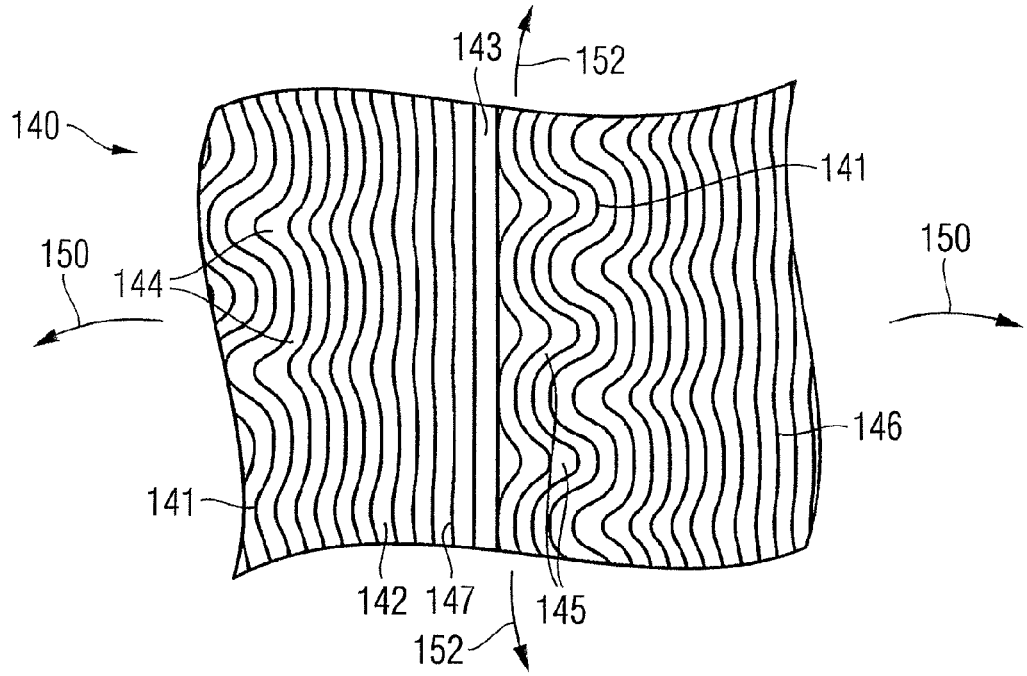
Figure 15:
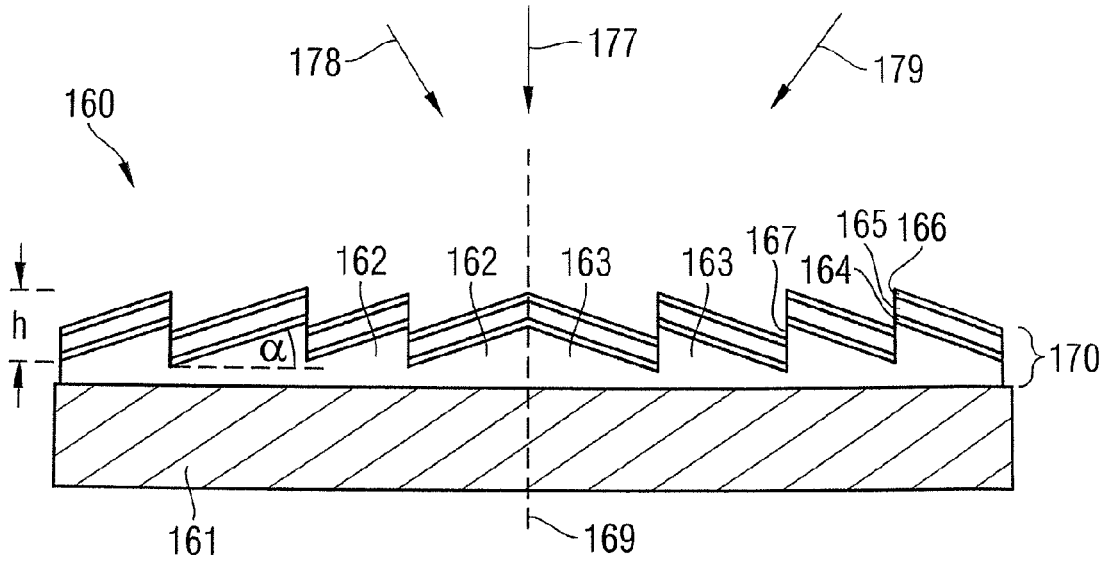

Shown are:

FIG. 1 a schematic diagram of a banknote having a see-through security element according to the present invention, FIG. 2 a cross section through an inventive see-through security element having a blind image, FIG. 3 a cross section through a see-through security element having a blind image, in which the lamellae are developed in the shape of a trapezoid, FIG. 4 in (*a*) and (*b*), intermediate steps in the manufacture of a see-through security element according to an exemplary embodiment of the present invention, FIG. 5 a schematic top view of a see-through security element according to a further exemplary embodiment of the present invention, FIG. 6 a section of the banknote in FIG. 1 having a see-through security element according to the present invention, in which the denomination of the banknote is repeated as an optically variable element, FIG. 7 a cross section through a see-through security element according to the present invention, having a marking layer that includes a pattern composed of depressions, FIG. 8 by way of example, a few embodiments for depressions that, in each case, lend the marking layer a defined increased transmittance, wherein (a) shows depressions of different widths and depths and (b) depressions having different contour shapes and sizes, FIG. 9 a see-through security element according to the present invention having a symmetric lamellar pattern that is provided with an asymmetric opaque coating, FIG. 10 a security element similar to that in FIG. 9, in which the pattern elements exhibit further surfaces of different slopes, FIG. 11 a security element similar to that in FIG. 9 and FIG. 10, having surface patterns having surfaces of different slopes and a symmetric metal coating, the see-through image taking effect at a vertical angle of impact of the metal vapor, FIG. 12 a security element similar to that in FIG. 9 to FIG. 11, in which the pattern elements are provided in sub-regions with light-absorbing moth-eye patterns, FIG. 13 a see-through security element having, on opposing surfaces of a substrate, see-through masks arranged with a predetermined offset, the motif of the see-through masks being visually perceptible when looked through only from a certain viewing direction (a), while the see-through security element appears opaque from other viewing directions (b), FIG. 14 a schematic top view of a see-through security element according to yet a further exemplary embodiment of the present invention, and FIG. 15 a cross section through a further inventive security element that exhibits micropattern elements that are provided with an optically variable coating.

The invention will now be explained using a security element for a banknote as an example. For this, FIG. 1 shows a schematic diagram of a banknote 10 having a see-through security element 12 having a blind image that is arranged over a see-through region 14, such as a window region or a through opening in the banknote 10. The through opening can be produced after the manufacture of the substrate of the banknote 10, for example by punching or laser cutting. However, it is also conceivable to produce the through opening during the manufacture of the banknote substrate, as described in WO 03/054297 A2. To that extent, the disclosure of WO 03/054297 A2 is incorporated in the present application.

As explained in greater detail in the following, the blind image of the see-through security element 12 displays a different visual appearance depending on the viewing direction. For example, the security element 12 can appear patternless and light when looked through vertically, while, upon tilting or rotating the banknote, dark markings in the form of patterns, characters or codes stand out. In other embodiments, the markings are already visible when looked through vertically, and disappear or change when the banknote is rotated or tilted.

What is important for the use of the see-through security element 12 in the banknote 10 or other securities is its low total thickness of less than 50 μm. The see-through security element preferably exhibits an even smaller layer thickness of only about 20 μm or even of only about 3 μm to 10 μm. The present invention provides multiple possibilities for producing optically appealing blind images with such low total thicknesses.

A first possibility for manufacturing a thin see-through security element having a blind image is illustrated based on the cross section through the security element 12 in FIG. 2. In the exemplary embodiment shown, first, a thin layer of a colored embossing lacquer 22 is applied to a transparent substrate 20. The embossing lacquer layer 22 is then patterned by means of embossing techniques in such a way that a lamellar pattern composed of a plurality of substantially parallel, individually situated lamellae 24 is formed.

When viewed parallel to the lamellae 24, so in the viewing direction 26, the security element 12 appears substantially transparent when looked through. If, in contrast, the viewer tilts the security element 12 out of the parallel viewing direction, for example in the viewing direction 28, then the lamellae 24 block the view through it, that is, the security element 12 appears opaque for the viewer.

The lamellar pattern constitutes a regular arrangement of a plurality of lamellae 24 having a characteristic pattern spacing that, according to the present invention, is 1 μm or more, such that, in the visible spectral range, the lamellae 24 effect no color splitting due to wavelength-dependent diffraction effects. In the exemplary embodiment in FIG. 2, the spacing of adjacent lamellae 24 is 5 μm, the pattern size, that is, the width of the individual lamellae, is 2.5 μm. The height of the embossed lamellae 24 is 5 μm, such that a height-to-width ratio of 2:1 results. In general, this ratio is between approximately 1:5 and approximately 5:1, preferably around or above 1:1 to approximately 5:1.

The rectangular profile of the lamellae 24 shown in FIG. 2 represents an idealization of the actual ratios in an embossed lacquer layer. In practice, the transitions at the top and bottom edges of the lamellae are rounded off to a certain extent, and the sides of the lamellae 24 are not completely vertical. Also a specific development of the lamellae 24 in the shape of a trapezoid having sides of a slope different than 90°, as shown, for example, in FIG. 3, may be used. Here, the slope of the sides is preferably between about 70° and about 85°. Here, too, in practice, the transitions at the top and bottom edges of the lamellae are not completely sharp, but rather somewhat rounded.

When looked through, the brightness of the security element 12 can be set within a broad scope through the ratio of lamella width to lamella spacing. Also the color impression can be largely freely chosen through the color of the embossing lacquer and of the transparent or translucent substrate.

Instead of a colored embossing lacquer 22, also a layer of a colorless embossing lacquer 32 can be applied to the substrate 20, as shown in FIG. 4. The colorless embossing lacquer 32 is then first patterned with an embossing die in such a way that depressions or trenches 34 are created in the form of the desired blind images, as illustrated in FIG. 4(*a*). Subsequently, the depressions 34 are filled with ink 36, as depicted in FIG. 4(*b*), to produce a blind image having the desired color impression.

The use of the embossing technique permits, in addition to the manufacture of blind foils having a very low total thickness of 50 μm or less, also the simple production of locally differently oriented lamellar patterns on the same security element. FIG. 5 shows, for illustration, a schematic top view of a see-through security element 40 according to a further exemplary embodiment of the present invention. The security element 40 exhibits, in a first region 42, a first lamellar pattern whose parallel lamellae 44 run vertically in the view in FIG. 5. In second regions 46, a second lamellar pattern is provided that exhibits identical lamella width and identical lamella spacing to the first lamellar pattern, whose likewise parallel lamellae 48, however, are oriented at a right angle to the lamellae 44.

When viewed vertically when looked through, due to their identical areal coverage, the regions 42 and 46 differ practically not at all in their visual appearance, the security element 40 appears patternless and light. If the security element is now tilted at a certain angle to the right or left (tilt direction 50), then the tilted lamellae 44 block the viewer's view through it, while the spaces between the parallel lamellae 48 in the regions 46 permit a view through as before. Thus, for the viewer, light circles 46 stand out against a dark background 42.

If, on the other hand, the viewer tilts the security element forward or backward (tilt direction 52), then the now tilted lamellae 48 block the view through, while the spaces between the lamellae 44 keep the region 42 light-transmitting. The viewer now sees dark circles 46 against a light background 42.

In an embodiment not further depicted, it is provided that the security element in FIG. 5 exhibits an additional transparent or semitransparent, for example optically variable, coating that, for example, is arranged between the substrate and the micropattern or on the micropattern. Through this measure, the counterfeit security of the security element shown in FIG. 5 is further increased.

The simple geometric pattern in FIG. 5 can, of course, be extended to more complex patterns, characters or codes. For example, to safeguard authenticity, the denomination 16 of the banknote 10 can be repeated in the see-through security element 12 in the form of regions 60, 62 having different lamella orientations, as shown in FIG. 6. As explained for the preceding exemplary embodiment, the see-through security element 12 appears patternless when viewed vertically, while the numeric string "10" stands out light against a dark background or dark against a light background when the banknote is tilted, depending on the tilt direction.

A further see-through security element according to yet a further embodiment of the present invention is shown in FIG. 14. The security element 140 in FIG. 14 exhibits, in principle, a similar pattern to the security elements in FIG. 5 and FIG. 6, and reference is therefore made to the explanations given for these figures.

The key difference in the see-through security element 140 with respect to the see-through security elements in FIG. 5 and FIG. 6 consists in that the regions of differently oriented lamellar patterns are significantly less sharply delimited from each other. While, for example, the regions 42 and 46 of the security element 40 in FIG. 5 are arranged vertical to one another, the lamellae 141, 147 of the security element 140 in FIG. 14 exhibit, in most regions, merely a non-rectilinear course, the differences in the direction of the course of adjacent regions being relatively small. As evident from FIG. 14, the meander-shaped lamellae 141 in regions 144 and 145 exhibit, in contrast, a course that deviates significantly from the preferred direction from top to bottom in FIG. 14, which is determined by the lamellae 147 in region 143.

When viewed vertically when looked through, due to their identical areal coverage, the regions 143, as well as 144 and 145 differ practically not at all in their visual appearance, the security element 140 appears substantially patternless and light. If, however, the security element 140 is tilted at a certain angle to the right or left (tilt direction 150), then the tilted lamellae 147 block the viewer's view through it, while the spaces between the lamellae 141 in the regions 144 and 145 at least partially permit a significantly extensive view through. In contrast to the regions 42 and 46 that are very sharply delimited from each other when the security element 40 in FIG. 5 is tilted, a continuous transition results between the regions 142, 143, 146 and 144, 145 of the security element 140 in FIG. 14 with respect to the orientation of the lamellae (curvature), which also results in the regions 144 and 145 contrasting less strongly with the regions 142, 143 and 146 when tilted in the direction 150. Thus, when the security element 140 is tilted, regions having lower transparency that gradually change into regions having substantially unchanged transparency result for the viewer. Accordingly, for the viewer, the regions of low transparency change relatively evenly into the lighter regions in the tilted security element 140.

When tilted in a direction 152 that is substantially vertical to direction 150, the spaces between the lamellae 147 keep the region 143 light-transmitting, while the now tilted lamellae 141 in the regions 144, 145 substantially block the view through. Accordingly, the viewer now sees dark regions 144, 145 that continuously change into the light regions 142, 143 and 146.

A security element 140 developed according to FIG. 14 exhibits a very high counterfeit security, since the complex wavy lamellar patterns cannot be composed of individual, possibly available lamella foils, or easily reproduced. Further, the continuous light/dark transitions are perceived by a viewer to be visually very appealing.

Also the security element from FIG. 14 can exhibit an optically variable coating that is arranged, for example, between the substrate and the micropattern or on the micropattern. The counterfeit security of such a security element, which is not further depicted, is further increased by such a measure.

The see-through security elements according to the present invention can include, instead of blind images whose micropatterns are formed by parallel lamellae, also other micropatterns, for example micropatterns composed of a plurality of depressions having increased transmittance.

Of course it is also conceivable that the substantially parallel arrangement of the lamellae is replaced, at least in regions, by a non-parallel arrangement, which in effect amounts to an increase in the counterfeit security of the security element, since such patterns can be reproduced only with great technical difficulty.

To illustrate, FIG. 7 shows a see-through security element 70 in which, first, a through dark embossing lacquer layer 74 is applied to a transparent substrate 72. Embossed in the embossing lacquer layer 74 are a plurality of depressions 76 in which the transmittance of the embossing lacquer layer 74 is increased due to the locally reduced layer thickness. Here, the depressions 76 are arranged such that, together, when looked through, they form a motif that appears and disappears depending on the viewing angle.

Due to the high resolution of the embossing technique and the small layer thicknesses, very fine configurations and complex motifs can be realized. Here, the depiction of the motifs is not limited to two-tone depictions (light/dark), but rather, as described in the following, also halftone depictions can be realized. To avoid undesired color splittings, according to the present invention, the characteristic spacing of the depressions is 1 μm or more, also in the embodiments in which the micropatterns comprise a plurality of depressions. The lateral dimensions of the depressions are advantageously likewise about 1 μm or more.

Different grayscales in the visual impression can be realized through different densities (number of depressions of a certain shape per surface element), depths or also through different shapes and sizes of the depressions 76. In this regard, FIGS. 8(*a*) and (*b*) show, by way of example, some embodiments for depressions 76*a*, 76*b*, 76*c* of different widths and depths, and for depressions 78 having different contour shapes and sizes that lend the embossing lacquer layer in each case a defined increased transmittance and thus can be used to construct halftone images. Realistic-seeming halftone images can generally already be produced with just a few grayscales, such that a low number of different depression shapes, sizes and depths is sufficient.

The manufacture of the micropatterns (lamellae or depressions) can occur, as described, by embossing, especially by embossing in a UV-curing embossing lacquer or a thermoplastic lacquer. Soluble dyes as well as pigment dyes can be used as colors for the embossing lacquers.

Alternatively, to manufacture the micropatterns, also printing techniques can be used that are capable of stringing together very finely patterned opaque and non-opaque regions. Given a sufficiently low total thickness, the desired effects can be obtained with any printing technique that is capable of producing an approx. 3 μm to 20 μm thick layer having depressions or trenches having diameters between 1 μm and 30 μm.

Particularly advantageously, the micro intaglio technique described in the likewise pending German patent application 10 2006 029 852.7 can be used, which combines the advantages of printing and embossing technologies. Summarized briefly, in the micro intaglio printing technique, a die form is provided whose surface exhibits an arrangement of elevations and depressions in the form of the desired micropattern. The depressions in the die form are filled with a curable colored or colorless lacquer, and the substrate to be printed on is pretreated for a good anchoring of the lacquer. Then the surface of the die form is brought into contact with the substrate, and the lacquer that, in the depressions in the die form, is in contact with the substrate is cured and, in the process, joined with the substrate. Thereafter, the surface of the die form is removed from the support again such that the cured lacquer that is joined with the support is pulled out of the depressions in the die form.

For a more detailed description of this micro intaglio method and the associated advantages, reference is made to the cited German patent application 10 2006 029 852.7, whose disclosure in this regard is incorporated in the present application.

The pattern elements of the micropatterns, for example the lamellae in FIGS. 2 to 6 or the depressions in FIGS. 7 and 8, can also be provided in sub-regions with an opaque, a reflective or an absorbing coating.

In this way, by means of pattern elements of locally different geometries, or by means of pattern elements having surfaces of different slopes, likewise see-through images whose visibility depends on the viewing angle can be produced.

To illustrate, the exemplary embodiment in FIG. 9 shows a security element 80 having a lamellar pattern composed of a plurality of substantially parallel, transparent lamellae 82 that are formed, as described above, with the aid of an embossing lacquer layer, a printing layer or a micro intaglio layer. The symmetric lamellar pattern 82 is asymmetrically provided with an opaque coating 84, as shown in FIG. 9. Here, the asymmetric coating can occur, for example, by oblique vapor deposition by means of a per se known vapor deposition method, for example, physical vapor deposition (PVD). The particle vapor provided for oblique vapor deposition then impinges on the micropattern elements or the substrate surface at an oblique, that is, non-vertical angle with respect to the substrate surface. Due to the asymmetry of the coating, a view through the transparent lamellae 82 is possible from the viewing direction 88, while the opaque coating 84 on the lamellae 82 blocks the view through from the viewing direction 86, such that the security element 80 appears opaque from the viewing direction 86 in the sub-region shown. In this way, for example, through suitable arrangement of the lamellae 82 and the coating 84, a see-through image can be produced that becomes visible only when the security element is tilted in the viewing direction 88.

Also the exemplary embodiment in FIG. 10 shows a micropattern 90 having symmetrically developed micropattern elements and having an asymmetric coating 92, produced, for example, by means of oblique vapor deposition, in which, however, the micropattern elements exhibit further surfaces of different slopes 94, 96, and thus increase the design freedom for the design of the see-through images.

With the aid of surface patterns 100 having areas of different slopes, also see-through images can be produced that become effective by means of coating 102 at a vertical angle of impact of the particle vapor, especially of the metal vapor, as illustrated with reference to the exemplary embodiment in FIG. 11.

Instead of an opaque or reflective coating, also an absorption pattern can be provided on the individual pattern elements. For example, FIG. 12 shows a security element 110 having a micropattern 112 having different pattern elements that are provided in sub-regions with so-called moth-eye patterns 114 that constitute effective light traps for the incident light.

In other embodiments, the pattern elements of the micropattern 112 are provided with diffraction gratings that diffract substantial portions of the light incident at a certain angle in directions outside of the viewing direction. Effective see-through tilt effects can also be realized through such a combination of a geometric micropattern having a characteristic element size of 3 μm to 50 μm with a diffraction pattern having a characteristic element size of approximately 300 nm to approximately 1000 nm.

It is understood that, if desired, the patterns can additionally be provided, vertically or obliquely, with a reflective layer or with a layer having a refractive index that differs significantly from the pattern elements.

Such a see-through security element having an additional coating is shown in FIG. 15. The security element 160 in FIG. 15 exhibits, applied on a transparent or translucent material 161, for example a plastic foil composed of PET, a micropattern 170 that, in turn, is formed from a plurality of micropattern elements 162 and 163 and, arranged on top of that, an optically variable coating having layers 164, 165 and 166. As can be seen in FIG. 15, the micropattern elements 162 and 163 that are arranged symmetrically to the symmetry plane 169 form a sawtooth-shaped relief pattern. The relief pattern can also be taken as a grating pattern having a relatively small grating angle α. In the example shown, the grating angle α is approximately 20°, even if even smaller angles up to approximately 5° or larger angles up to approximately 45° are conceivable. In the embodiment shown in FIG. 15, the height h of the individual grating lines is approximately 5 μm.

Arranged over the micropattern is a three-layer optically variable coating. The individual layers 164, 165 and 166 were applied by vapor deposition from a direction oriented substantially vertical to the substrate surface. Ideally, the sides 167 of the relief pattern that are arranged parallel to the vapor deposition direction exhibit no optically variable coating. The three-ply coating having a color-shift effect is a metallic/dielectric structure having the following configuration. First, a layer 164 composed of aluminum is applied, preferably by vapor deposition, to the relief patterns fabricated from a UV-embossing lacquer. The layer serves as a reflector and exhibits a layer thickness of approximately 10 nm to 100 nm, preferably of approximately 30 nm. Over this, a layer composed of $SiO_2$ is normally applied, likewise by vapor deposition, with a layer thickness of 100 nm to 1000 nm, particularly preferably with a layer thickness of approximately 200 nm to 600 nm. The thickness of the $SiO_2$ layer determines the color-shift effect that is later perceptible by the viewer for the pattern. Finally, over the layer composed of $SiO_2$ is vapor deposited a semitransparent layer composed of chrome that exhibits a layer thickness of approximately 3 nm to 10 nm. The three-layer pattern obtained in this way exhibits a color-shift effect from green (top view, direction 177) to magenta (oblique viewing angle, direction 178, 179).

The embodiment of the inventive see-through security element shown in FIG. 15 shows for the viewer, in top view (direction 177), substantially the same color for the regions of the micropattern 170 that are provided with the micropattern elements 162 and 163. In contrast, when the security element is tilted out of the vertical viewing direction 177 toward an oblique viewing direction 178 or 179, the color impression for the regions of the security element 160 that are provided with the micropattern elements 162 and 163 changes significantly due to the then different angle between the irradiated light and the interference layer arrangement, having the layers 164, 165, 166, that is present on the micropattern elements 162 and 163, the plane 169 constituting a sharp boundary between the regions, having the elements 162 and 163, that, for the viewer, are perceived to be differently colored.

The security element 160 is extraordinarily counterfeit-proof due to the superimposition of a relief pattern and a coating having a color-shift effect, and the resulting synergistic effects. Furthermore, such an optically variable security element is very appealing for the viewer, such that a security element according to this embodiment has a particularly high recognition value.

A further exemplary embodiment of the present invention is illustrated in FIG. 13. The see-through security element 120 shown there exhibits a transparent or translucent substrate 122 having a first surface and an opposing second surface, a see-through mask 124 being applied to the first surface as a micropattern. The see-through mask 124 is formed by an opaque layer 126 having light-transmitting openings 128 having a size below 200 μm, preferably having a size of about 5 μm to about 100 μm, the arrangement of the openings forming a motif in the form of patterns, characters or a code.

A congruent see-through mask 130 is applied to the opposing second surface of the substrate 122 with a certain lateral offset Δ of less than 100 μm, for example of only 10 μm.

As illustrated in FIG. 13(*a*) and FIG. 13(*b*), through suitable choice of the size of the openings 128, the thickness of the substrate 122 and the offset Δ, it can be achieved that the motif of the see-through masks 124, 130 is visually perceptible when looked through only from a certain viewing direction 132, while the see-through security element 120 appears opaque from other viewing directions 134.

The opaque layers of the see-through masks can be produced through known printing methods, by embossing in color layers, by embossing depressions in transparent lacquer and subsequently filling the depressions with ink, through metallization/demetallization, and preferably through the above-mentioned micro intaglio technique according to German patent application 10 2006 029 852.7. Also, it is conceivable, in principle, that the see-through mask on one side of the substrate is obtained through, for example, an embossing technique, but the see-through mask on the other side of the substrate through a suitable metallization or demetallization technique. In the case of demetallization, different laser techniques can be used advantageously, since see-through masks of high spatial resolution can be obtained with them.

To achieve the required small offset of the see-through masks, these can especially be applied simultaneously to the opposing surfaces of the substrate. If, on the other hand, the see-through masks are applied in succession, particular attention must be paid to the registration of the micropatterns, especially their alignment with the size of the openings 128. If larger openings 128 are used, then the registration is less critical, such that in this case, also application methods with greater register tolerance can be used.

Also for the case of the embodiment shown in FIG. 13, it is, in principle, conceivable to arrange an additional coating, for example an optically variable, semitransparent thin film arrangement, on or under the see-through masks. The additional coating is advantageously patterned just like the see-through mask, so exhibits the same motif, which can be achieved, for example, through demetallization techniques.

If, as shown in FIG. 13, the see-through masks are not congruent, but rather exhibit different motifs, i.e. different regions of transparency, it is possible to achieve interesting Moirè effects and effects that depend on the tilt or rotation angle when the see-through security element is tilted or rotated. However, these special effects will not be addressed in greater detail in the present application.

The invention claimed is:

1. A see-through security element for security papers and value documents, comprising:

a see-through region in the security element, wherein the see-through region includes at least one micropattern formed from an arrangement of a plurality of pattern elements wherein the see-through region is capable of allowing visible light to be transmitted therethrough, wherein the at least one micropattern is not visible in the transmitted visible light when seen looking toward the see-through region in a direction perpendicular to a plane of the security element, and wherein the at least one micropattern is visible in the transmitted visible light when seen looking at the see-through region at an angle oblique to the perpendicular direction.

2. The see-through security element according to claim 1, characterized in that the pattern elements are provided in sub-regions with an opaque, transparent, semitransparent, reflective or absorbing coating.

3. The see-through security element according to claim 2, characterized in that the coating is formed of two, three, or more layers.

4. The see-through security element according to claim 2, characterized in that the coating is formed as a thin-film element having a color-shift effect.

5. The see-through security element according to claim 2, characterized in that the pattern elements exhibit an asymmetrically arranged coating, moth-eye pattern or diffractive pattern.

6. The see-through security element according to claim 1, characterized in that the pattern elements are provided in sub-regions with a metallic coating.

7. The see-through security element according to claim 1, characterized in that the pattern elements are provided in sub-regions with a moth-eye pattern.

8. The see-through security element according to claim 1, characterized in that the pattern elements are provided in sub-regions with a diffractive pattern that diffracts substantial portions of the incident light in directions outside of the viewing direction.

9. The see-through security element according to claim 1, wherein the at least one micropattern comprises a lamellar pattern composed of a plurality of substantially parallel lamellae, the substantially parallel lamellae aligning substantially parallel to one another in the perpendicular direction.

10. The see-through security element according to claim 9, characterized in that multiple micropatterns formed by lamellar patterns are provided that differ in one or more of the parameters lateral orientation, color, width, height, relief shape and spacing.

11. The see-through security element according to claim 10, characterized in that the differing lamellar patterns are arranged in the form of patterns, characters or a code.

12. The see-through security element according to claim 1, characterized in that the see-through security element exhibits a transparent or translucent substrate and, applied on the substrate, a marking layer that includes the at least one micropattern.

13. The see-through security element according to claim 12, characterized in that the marking layer is a colored embossing lacquer layer including non-embossed regions that form the pattern elements of the at least one micropattern.

14. The see-through security element according to claim 12, characterized in that the marking layer is a transparent or translucent embossing lacquer layer that exhibits embossed depressions that include colored material and that form the pattern elements of the at least one micropattern.

15. The see-through security element according to claim 12, characterized in that the marking layer is a printing layer having regions of high transmittance and having regions of low transmittance, the regions of low transmittance forming the pattern elements of the at least one micropattern.

16. The see-through security element according to claim 12, characterized in that the marking layer is a micro intaglio layer having regions of high transmittance and having regions of low transmittance, the regions of low transmittance forming the pattern elements of the at least one micropattern.

17. The see-through security element according to claim 1, characterized in that the pattern elements exhibit a characteristic pattern spacing of 5 μm or more.

18. The see-through security element according to claim 1, wherein the pattern elements have a pattern spacing in a range from 1 μm to 250 μm.

19. The see-through security element according to claim 18, wherein the spacing of the pattern elements is within a range from 3 μm to 50 μm.

20. The see-through security element according to claim 1, wherein the pattern elements have a height-to-width ratio of about 1:5 up to about 5:1.

21. The see-through security element according to claim 20, wherein the pattern elements have a height-to-width ratio of between 1:1 and 5:1.

22. The see-through security element according to claim 1, characterized in that at least one micropattern in a marking layer is formed by a plurality of depressions having an increased transmittance.

23. The see-through security element according to claim 22, characterized in that the plurality of depressions are arranged in the form of patterns, characters or a code.

24. The see-through security element according to claim 1, characterized in that the see-through security element exhibits a transparent or translucent substrate having a first and an opposing second surface, a see-through mask being applied to the first surface as a micropattern, and a congruent see-through mask being applied to the second surface with a predetermined lateral offset of 100 μm or less.

25. The see-through security element according to claim 24, characterized in that the see-through mask includes a motif, in the form of patterns, characters or a code, that is visually perceptible when looked through only at a certain viewing angle.

26. The see-through security element according to claim 24, wherein the see-through masks are each formed by an opaque layer having transmissive openings having a size of less than 200 μm, the openings forming a motif in the form of patterns, characters or a code.

27. The see-through security element according to claim 26, wherein the transmissive openings have a size from about 3 μm to about 100 μm.

28. A security paper for manufacturing value documents that is furnished with the see-through security element according to claim 1.

29. A data carrier, especially a value document such as a banknote, identification card or the like, that is furnished with the see-through security element according to claim 1.

30. The see-through security element according to claim 1, wherein the see-through security element has a total thickness of 50 μm or less.

31. The see-through security element according to claim 30, wherein the see-through security element has a total thickness of 20 μm or less.

32. The see-through security element according to claim 31, wherein the see-through security element has a total thickness in a range from 3 μm to 10 μm.

* * * * *